US006820615B1

(12) United States Patent
Feng

(10) Patent No.: US 6,820,615 B1
(45) Date of Patent: Nov. 23, 2004

(54) MASK TIGHTENING STRAP

(76) Inventor: Li-Jen Feng, No. 22-10, Lane 50, Tian Muu E. Rd., Taipei (TW)

( * ) Notice: Subject to any disclaimer, the term of this patent is extended or adjusted under 35 U.S.C. 154(b) by 0 days.

(21) Appl. No.: 10/816,344

(22) Filed: Mar. 31, 2004

(51) Int. Cl.[7] ..... B63C 11/02

(52) U.S. Cl. ..... 128/201.27; 128/201.11; 128/207.11; 128/207.17; 128/205.25; 2/426; 2/428; 2/429; 2/430; 2/452; 2/909; 2/918

(58) Field of Search ..... 128/201.11, 201.27, 128/DIG. 15, 207.11, 207.17, 205.25; 2/426, 428, 429, 430, 918

(56) References Cited

U.S. PATENT DOCUMENTS 1,324,747 A * 12/1919 Runyan ..... 128/206.24
2,780,224 A * 2/1957 Wallace ..... 128/207.11
2,818,067 A * 12/1957 Issaiewitch et al. ... 128/201.11
3,653,086 A * 4/1972 Gongwer ..... 2/9
3,680,556 A * 8/1972 Morgan ..... 128/201.15
4,029,092 A * 6/1977 Morgan ..... 128/201.11
4,077,068 A * 3/1978 Anderson ..... 2/428
4,230,106 A * 10/1980 Geeslin et al. ..... 128/201.11
4,304,229 A * 12/1981 Curtin ..... 128/201.11
4,562,836 A * 1/1986 Perron ..... 128/201.11
4,607,398 A * 8/1986 Faulconer ..... 2/452
5,046,200 A * 9/1991 Feder ..... 2/452
D322,082 S * 12/1991 Bolle ..... D16/303
5,181,280 A * 1/1993 Zachry, Jr. ..... 2/452
5,193,530 A * 3/1993 Gamow et al. ..... 128/201.27
5,199,421 A * 4/1993 Figgiani et al. ..... 128/201.11
D335,322 S * 5/1993 Jones ..... D24/110.2
5,303,428 A * 4/1994 Pernicka ..... 2/452
5,402,774 A * 4/1995 Tiballi ..... 128/201.11
5,485,832 A * 1/1996 Joffity ..... 128/201.11
D367,875 S * 3/1996 Lutz et al. ..... D16/311
5,553,331 A * 9/1996 Gentile ..... 2/430
5,558,466 A * 9/1996 Kuo et al. ..... 405/186
5,566,427 A * 10/1996 Lathrop ..... 24/169
5,572,989 A * 11/1996 Lutz et al. ..... 128/201.18
5,575,277 A * 11/1996 Lutz et al. ..... 128/201.18
5,687,712 A * 11/1997 Semeia ..... 128/205.24
5,706,526 A * 1/1998 Huang ..... 2/428
5,742,946 A * 4/1998 Garofalo ..... 2/428
D401,958 S * 12/1998 Berke ..... D16/312
D406,333 S * 3/1999 Garraffa ..... D24/110.5
5,881,394 A * 3/1999 Garofalo ..... 2/428
5,901,702 A * 5/1999 Bernard ..... 128/201.11
5,906,199 A * 5/1999 Budzinski ..... 128/201.11
5,983,406 A * 11/1999 Meyerrose ..... 2/452
6,073,626 A * 6/2000 Riffe ..... 128/201.11
6,119,693 A * 9/2000 Kwok et al. ..... 128/207.11
6,155,253 A * 12/2000 Gamberini ..... 128/201.18
6,167,882 B1 * 1/2001 Almqvist et al. ..... 128/201.27
D450,833 S * 11/2001 Olivieri ..... D24/110.2
6,318,363 B1 * 11/2001 Monnich ..... 128/201.11
6,341,383 B1 * 1/2002 Beltrani ..... 2/452
6,352,075 B1 * 3/2002 Wang ..... 128/201.11
6,367,085 B1 * 4/2002 Berg ..... 2/202
6,401,716 B1 * 6/2002 Sword et al. ..... 128/206.21
6,427,694 B1 * 8/2002 Hecker et al. ..... 128/206.21

(List continued on next page.)

*Primary Examiner*—Henry Bennett
*Assistant Examiner*—Nihir Patel
(74) *Attorney, Agent, or Firm*—Pro-Techtor International Services

(57) ABSTRACT

A mask tightening strap, whereby a tightening device of a conventional diving face mask or swimming goggles is configured to comprise a protective sleeve attached to an inner side of a tightening strap. A fastening strap is configured on one end of the protective sleeve close to a frame of the diving mask. A hollow out portion is defined by a side of the fastening strap, and thereby enables a retaining ring of a breathing tube to clasp onto a strap in the hollow out portion. The protective sleeve can thus realize complete separation of the retaining ring from skin of a diver, and thus not only makes wearing of the face mask more comfortable, but also averting hypersusceptibility skin reactions from occurring or scratching of the skin of the diver.

3 Claims, 4 Drawing Sheets

U.S. PATENT DOCUMENTS 6,435,178 B1 * 8/2002 Lin ..... 128/201.27
6,460,196 B2 * 10/2002 Tsubooka et al. ..... 2/428
6,463,640 B1 * 10/2002 Toth ..... 24/648
6,477,717 B1 * 11/2002 Winefordner et al. ..... 2/428
6,478,024 B1 * 11/2002 White, Jr. ..... 128/201.11
6,626,178 B2 * 9/2003 Morgan et al. ..... 128/206.26
6,644,307 B2 * 11/2003 Morgan et al. ..... 128/200.29
D484,171 S * 12/2003 Urabe ..... D16/312
6,668,822 B2 * 12/2003 Monnich ..... 128/201.11
6,736,136 B2 * 5/2004 Chen-Lieh ..... 128/201.11

* cited by examiner

A

MASK TIGHTENING STRAP

BACKGROUND OF THE INVENTION (a) Field of the Invention

The present invention relates to face masks used for diving and snorkeling, and more particularly to a mask strap cover. The strap cover consists of a hollowed-out section for a snorkel's retaining ring. The snorkel can be adjusted within the hollowed-out section, along the strap, to allow it to be angled at the most comfortable position. The strap cover also prevents the likelihood that the diver's face will be scratched, scraped or injured during the adjustment.

(b) Description of the Prior Art

A diver's mask typically incorporates a strap, connected to the mask frame, which is tightened to bring the mask closer to the diver's face preventing water to enter the mask during use. FIG. 1 shows a conventional mask with a strap 200 and 201 connected to the frame 100. A snorkel 400, the predominant form of a breathing tube, is used with the mask and may be clasped onto the mask strap 201 via a retaining ring 300 to prevent the top of the snorkel from falling into the water during use. The conventional method is to have the ends of the strap 200 and 201 loop through slots located along the edges of the mask frame 100, allowing the mask to be adjusted along both sides. This type of side adjustment method has its many disadvantages. First, the diver is required to bring both his hands to one side of his head to make the adjustment, and can only adjust one side at a time. If the mask is on his head, the adjustment process is awkward, because the diver needs to tilt his head to the right or the left, depending on which side the adjustment is being made. Trying to make the adjustment before putting the mask on can require numerous trial-error attempts, because straps normally are evenly proportioned and the right adjustment cannot be felt unless the mask on the diver's head. The more suitable faster method, which is provided here, is an adjustment 500 that is located at the back-of-the-head (see FIGS. 2 and 4), allowing the diver to bring both hands over the top of his head in a more coherent motion, to tighten or loosen the mask. The dual-simultaneous back adjustment does not require two steps to adjust the mask, but rather the two ends of the straps can be pulled outward to adjust both strap sides. The back adjustment is usually done while the mask is on, allowing the fit to made and felt immediately, and can be made comfortable with an arced shape for the back of the diver's head as provided. Regardless of which type of adjustment is used, the strap 200, with or without the back adjustment 500, when used with the retaining ring 300 can present the following drawbacks:

1. A hard retaining ring will directly press against the temples or sides of the diver's face, causing discomfort and the potential for adverse skin reactions and injury including bleeding during diving and snorkeling for extended lengths of time and, 2. As the diver during use in the water attempts to adjust the position of the snorkel 400 by moving the retaining ring 300, his face can be scraped and scratched by the hardness or sharp edges of the retaining ring.

SUMMARY OF THE INVENTION

A primary objective of the present invention is to provide a strap cover for a diving mask. The strap cover integrates the use of a snorkel. retaining while protecting the diver's face from the hardness of the retaining ring. The strap cover has a hollowed-out section near the frame of the mask through which a snorkel retaining ring can be attached and moved about to and fro for adjustment during use. The strap cover is made of a soft, or cushiony, material to shield the diver's face from the hard surfaces of the snorkel's retaining ring.

DETAILED DESCRIPTION OF THE PREFERRED EMBODIMENTS

Figure 1:
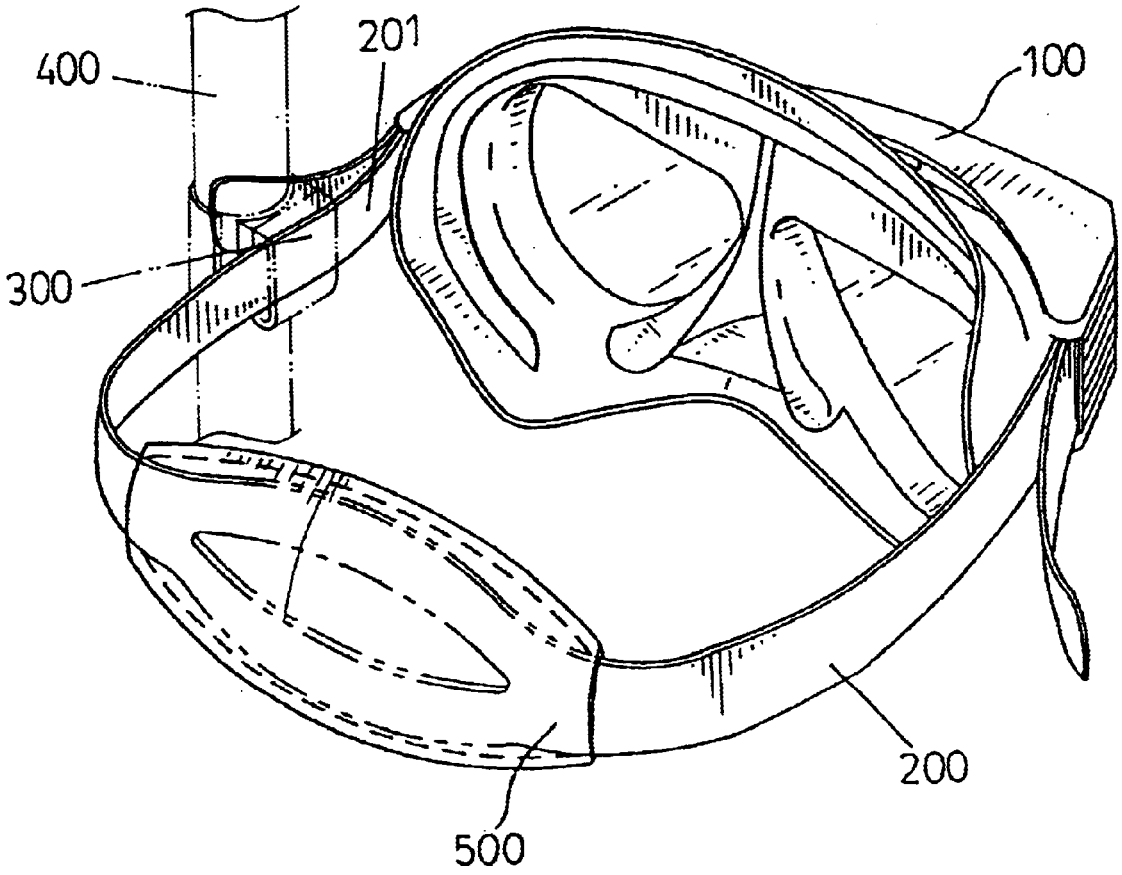
FIG.1 (PRIOR ART)
FIG. 1 shows a schematic view of a conventional diving mask.
Figure 2:
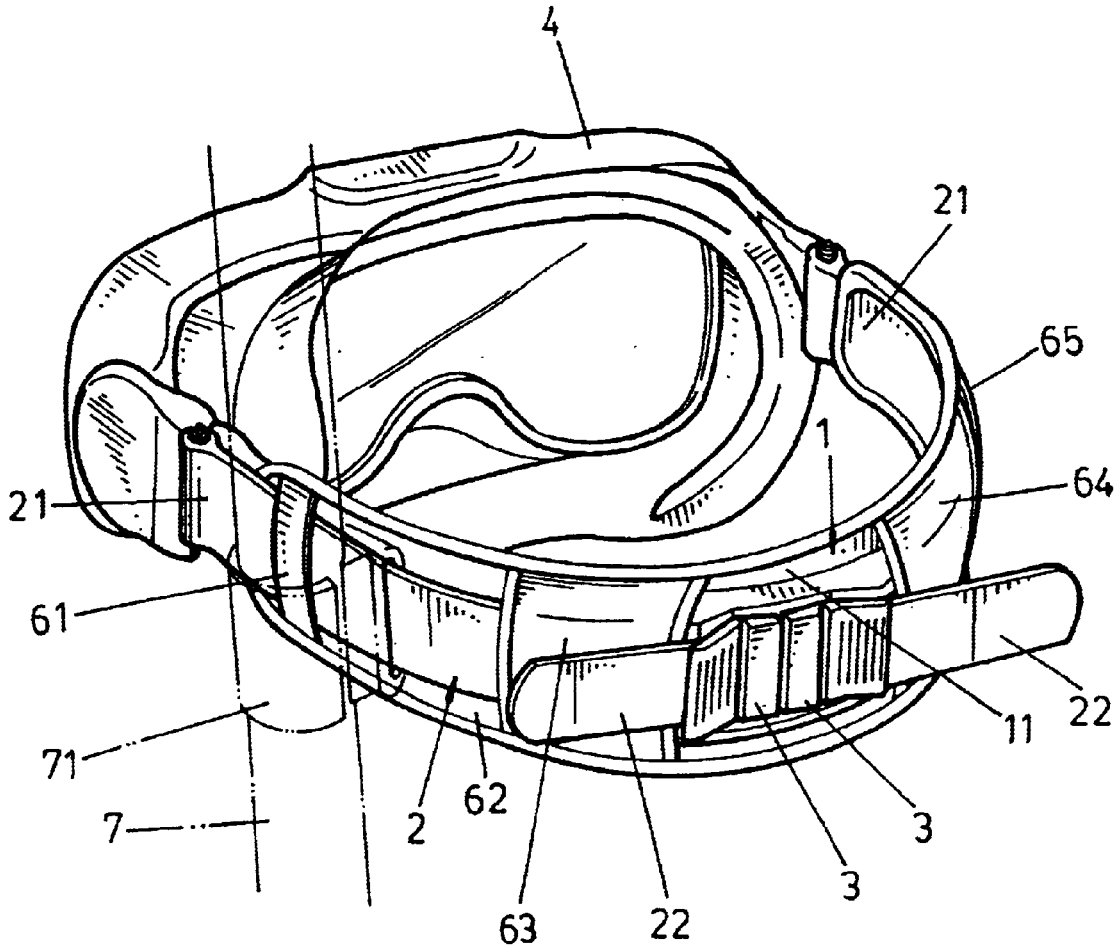
FIG. 2 shows a schematic view of the present invention with an arc-shaped back-of-the-head adjustment.
Figure 3:
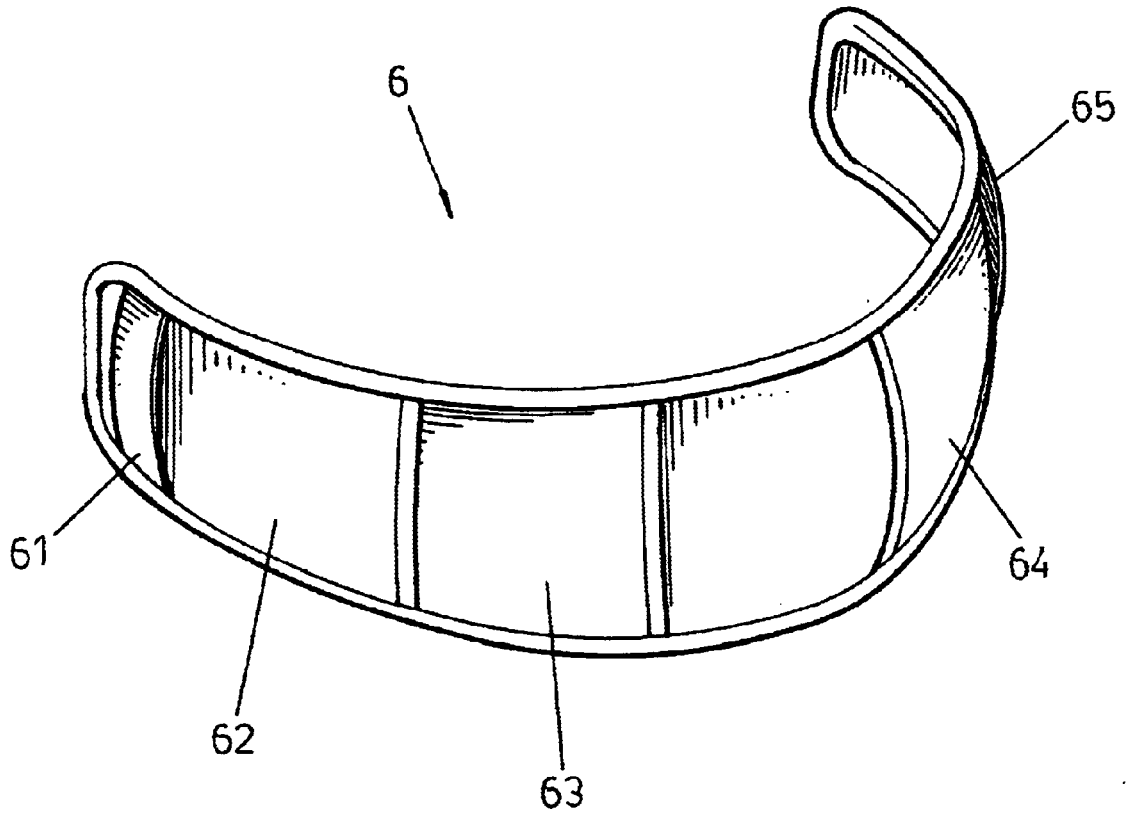
FIG. 3 shows a schematic view of the strap cover.
Figure 4:
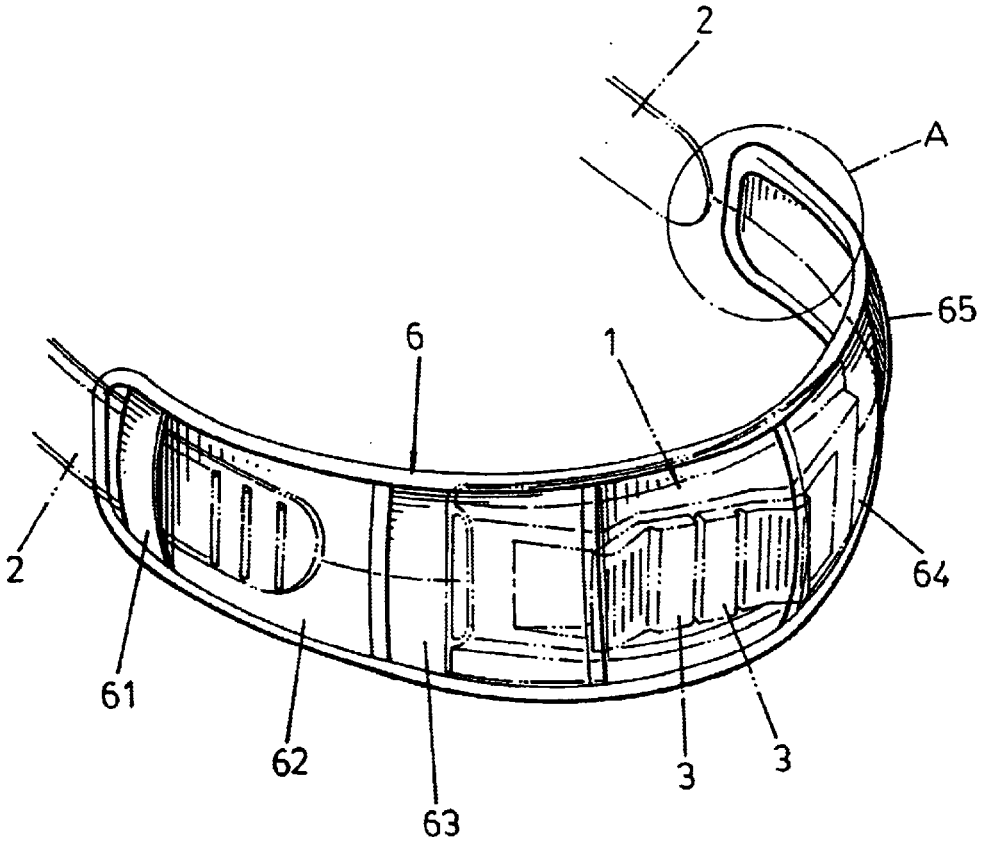
FIG. 4 shows a schematic view of the strap cover with the back-of-the-head adjustment illustrating the hollowed-out sections for the retaining ring and the adjustment.

FIG. 2 shows a diving face mask with the tightening strap of the present invention incorporating an arc-shaped assembled piece 1, two straps 2, two pressure pieces 3, and a frame 4 of the face mask.

The arc-shaped assembled piece 1 has an arc-shaped piece 11 that conforms to the arc-shape of the back of the head of a diver (for comfort during use). The two pressure pieces 3 are located on the central portion on the exterior of the arc-shaped assembled piece 1.

Fastening ends 21 of the two straps 2 are respectively pivotally affixed to each of the two side pieces of the frame 4 of the diving face mask (see FIG. 2), and the free ends 22 of the straps 2 are each threaded through two sides of the arc-shaped assembled piece 1, folding backward along the exterior of the two sides, enabling the free ends 21 to fold backwards. The present invention is primarily characterized in the following way:

FIGS. 2, 3, 4, 5, and 6 show the inner sides of the two straps 2 sleeved within a soft cover 6 having a broad surface (see FIG. 3), in order to completely separate the two straps 2 from the diver's skin. The strap cover 6 has a fastening strap 61 that is located in close proximity to the frame 4. The hollowed-out section 62 is defined by a side, right or left, of the strap cover 6 configured to enable a retaining ring 71 of a snorkel 7 to clasp on the strap 2 through the hollowed-out section 62, allowing the strap cover 6 to completely separate the retaining ring 71 from the diver's skin. Two strap loops 63 and 64 are incorporated onto strap cover 6. The arc-shaped assembled piece 1 is centrally positioned between strap loops 63 and 64 for ease of reaching. FIG. 2 shows the snorkel 7 utilizing the retaining ring 71 clasping onto the strap 2 on the left side of the hollowed-out section section 62, clearly separating the retaining ring 71 from the diver's skin. The strap 2 does not need a snorkel 7 to be clasped onto its right side. Another strap loop 65 on the other side is attached to the strap cover 6 for the strap 2. Another hollowed-out section on the other side of the strap cover 6 is not necessary.

Figure 6:
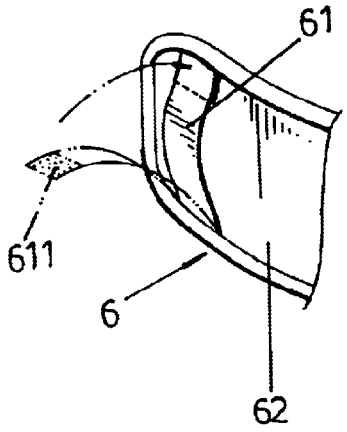
FIG. 6 shows a fragmentary view of the other end of the strap cover.
Figure 5:
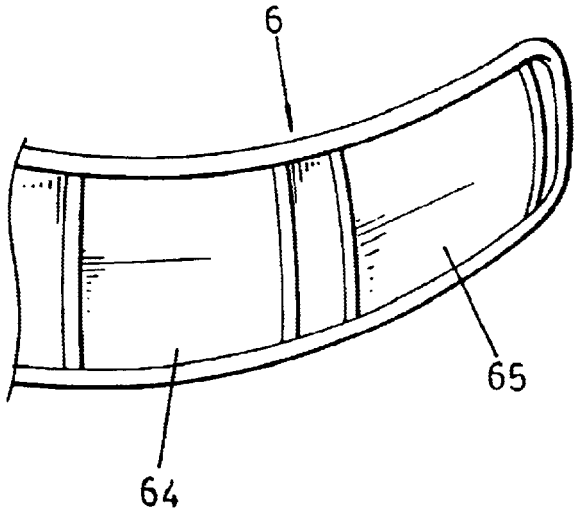
FIG. 5 shows a partial schematic view of the strap cover.

A sewn-on or hook and loop fastening strip can be utilized to affix the fastening strap 61 to the strap cover 6 (see FIG. 6).

A soft rubber or foam rubber pad can be affixed to the inner side of the strap cover 6, and the inner sides of the straps 2 are sleeved within the strap cover 6. The fastening strap 61 is configured near the frame 4 on one end of the strap cover 6.

The embodiments described herein is merely illustrative of the principles of the invention and a wide variety of modifications may be effected by persons skilled in the art. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. The mask tightening strap comprising an arc-shaped, adjustable fastening unit, two straps, two pressure pieces, and a frame for the mask, whereby said two pressure pieces are configured at a central portion on an exterior surface of said arc-shaped fastening unit;

fastening straps of said two straps are respectively pivotally affixed to each of the side pieces of said frame, and free ends of said traps are each threaded through two sides of said arc-shaped fastening unit; and said straps are then folded back along the exterior of the two sides;

and characterized such that the inner sides of said traps are sleeved within a strap cover close to said frame, an hollowed-out section, or hollowed-out portion, is defined by the side of said fastening strap configured to enable a retaining ring of a snorkel to clasp onto the strap through its said hollowed-out section, thereby completely separating said retaining ring from the diver's skin.

2. The mask tightening strap according to claim 1, on which there are a certain number of strap loops, said hollow-out section of the strap cover, and the strap loop are attached near the end of the frame in order to completely cover said strap.

3. The mask tightening strap according to claim 1, wherein the fastening strap of the strap cover utilizes a hook and loop fastening strip or is sewn onto the strap cover to encase the strap.

* * * * *